US005395296A

United States Patent [19]

Webster et al.

[11] Patent Number: 5,395,296

[45] Date of Patent: Mar. 7, 1995

[54] EXERCISE APPARATUS UTILIZING ARRAY OF ELASTIC MEANS

[76] Inventors: Timothy D. Webster, 1486 Main St., Concord, Mass. 01742; Robert T. Wyld, 31 Newport Dr., Westford, Mass. 01886

[21] Appl. No.: 376,874

[22] Filed: Jul. 7, 1989

Related U.S. Application Data

[63] Continuation of Ser. No. 270,393, Nov. 10, 1988, abandoned, which is a continuation of Ser. No. 796,287, Nov. 8, 1985, abandoned.

[51] Int. Cl.[6] ..... A63B 21/04

[52] U.S. Cl. ..... 482/130; 402/907

[58] Field of Search ..... 482/23, 26, 35–37, 482/121–130, 142–143, 148, 907

[56] References Cited

U.S. PATENT DOCUMENTS

| | | | |
|---|---|---|---|
| 3,130,630 | 4/1964 | Dawes . | |
| 3,171,652 | 3/1965 | Newman . | |
| 3,345,067 | 10/1967 | Smith | 482/123 |
| 3,465,750 | 9/1969 | Schawalder | 482/130 X |
| 3,544,103 | 12/1970 | Conable | 482/130 |
| 3,659,844 | 5/1972 | Cummins | 482/130 |
| 3,722,885 | 3/1973 | Leaf . | |
| 3,825,252 | 7/1974 | Geiger . | |
| 4,072,309 | 2/1978 | Wilson . | |
| 4,089,520 | 5/1978 | Ozbey et al. | 482/130 |
| 4,198,044 | 4/1980 | Holappa . | |
| 4,204,676 | 5/1980 | Givens | 482/130 |
| 4,241,914 | 12/1980 | Bushnell . | |
| 4,403,773 | 9/1983 | Swann . | |
| 4,537,393 | 4/1985 | Kusch . | |
| 4,570,921 | 2/1986 | Arnold . | |

FOREIGN PATENT DOCUMENTS

| | | | |
|---|---|---|---|
| 2164974 | 7/1973 | Germany | 482/121 |
| 2832918 | 2/1980 | Germany | 482/130 |

*Primary Examiner*—Richard J. Apley
*Assistant Examiner*—John Mulcahy
*Attorney, Agent, or Firm*—Blodgett & Blodgett

[57] ABSTRACT

Exercise apparatus including a spaced array of tensioned elastic cords removably connected to a support and constitutes an inexpensive, compact, flexible mechanism for providing a substantial variety of continuously variable or controlled, repeatable exercise. The elastic cords in the array are simultaneously accessible to portions of the body over a wide range of orientations because of a generally convex or frustocontical outline formed by the array to permit multiple multidirectional resistive-type exercises in nearly all directions. The elastic cords preferably comprise shock cords, and the shock cords and/or supporting structures advantageously carry visible indicia to indicate the degree of difficulty of the routine or to facilitate use of the apparatus to conduct a preplanned exercise program.

1 Claim, 7 Drawing Sheets

EXERCISE APPARATUS UTILIZING ARRAY OF ELASTIC MEANS

This is a continuation of application Ser. No. 270,393, filed Nov. 10, 1988, which is a continuation of Ser. No. 796,287, filed Nov. 8, 1985, both now abandoned.

FIELD OF THE INVENTION

The present invention relates generally to exercise apparatus and, more particularly, to an exercise apparatus which utilizes primarily elastic means for providing a wide range of static, semi-static and ballistic exercises which may be, selectively, either continuously variable or controllable and repeatable.

BACKGROUND OF THE INVENTION AND PRIOR ART

Various types of exercise equipment have been used over the years to provide different types of desired exercises. Flexible or elastic means have often been used to provide stretching exercises of fairly limited application. For example, such exercise apparatus might provide for tension in a single direction substantially along the (stationary or movable) longitudinal axis of the flexible member.

Recently there has been an increase in interest in exercise apparatus. However, typically, each exercise apparatus—whether of the resistance, weight or hydraulic machine variety, is limited in its range of motion and provides exercises for one or a very small number of muscle groups of the body. In addition, most commonly such devices must be reconfigured or readjusted or weights must be changed in order to provide flexibility in exercise routines.

In addition, it is not uncommon for exercise apparatus for a total program of exercises to require between 8 and 15 separate stations at which individual exercises or groups of exercises are performed. Often each such station costs of the order of $2000–$4000 and, thus, in order to provide a "full fitness" gym, substantial expenditures and the consumption of significant amounts of space must be encountered.

Accordingly, it would be desirable to have a relatively simple, inexpensive, and compact exercise apparatus which provides for a plurality of exercises for each of the main muscle groups of the body and which is easily adaptable for use in an exercise program, yet provides the flexibility required for the development of individual programs for the numerous individuals who may use the same piece of equipment. Rather than using many of the complex mechanical structures presently in use, the present invention is directed towards an exercise apparatus which utilizes elastic or flexible means for providing a variety of exercises, consumes relatively little space, and is comparatively inexpensive.

Various exercising elastic (or stretching) type apparatus are disclosed in the prior art. Such devices are shown, for example, in Caines (U.S. Pat. No. 1,112,114), Sandow (U.S. Pat. Nos. 610,416 and 588,017), Hunter (U.S. Pat. No. 3,540,724) and Bushnell (U.S. Pat. No. 4,241,914). The latter of these prior art patents discloses an elongate tensioned elastic means 13 attached at both ends to a frame and responsive to yieldingly resist muscular exertion by a person when deflected by such exertion during exercises and to yieldingly assist generally upward bodily movement during exercises when downwardly deflected by the body weight of the person before the exercises are performed. The upward bodily movement occurs during the muscular exertion against at least one surface substantially fixed in position during the exercise. Manual means is also disclosed for selectively varying the position for the entire length of the elastic means in the frame.

None of the known prior art exercise apparatus (including that utilizing elastic or flexible means), however, provides for a variety of variable or repeatable exercises for all of the major muscle groups of the body while at the same time being relatively inexpensive, compact and simple to use.

Wherefore, it is an object of the present invention to provide such an exercise apparatus which permits static (stretching muscles by muscle movement only), semi-static (stretching muscles both by muscle movement and by the force of another object) and ballistic (moving body portions against resistive means in a vigorous in and out manner) exercises either of the continuously variable nature or in a controlled repeatable sequence, yet may be simply modified to provide for differing degrees of difficulty for the same repeated sequences and which is easily adaptable for use in a defined, preplanned exercise program.

SUMMARY OF THE INVENTION

The foregoing objectives have been accomplished in an exercise apparatus which includes a substantially stationary support and an array of elongated tensioned elastic means spaced apart from each other and having substantial portions thereof spaced apart from the support. Each of the elastic means has portions attached to separate portions of the support and is responsive to yieldingly resist muscular exertion by the person performing the exercise when deflected in any (nearly unlimited number of) of a plurality of directions by such muscular exertion. The array of elastic means generally defines a convex-shaped surface surrounding a portion of the individual performing the exercise in one lateral direction from the person, and the elastic means comprises shock cords, commonly called "Bunji" cords, which provide for a substantially increasing amount of tension after an initial deflection at any particular location between points at which the shock cords are removably connected to the frame. Further, the "convex" arrangement of the cords, whereby they effectively project from a substantially "common" back plane to one or more attachment points on the frame in one or more separate forwardly-spaced planes permits substantially continuous adjustments in particular exercises to be made by varying the particular location at which a portion of the body engages the cord along the length of the cord. The cords extend generally radially outward from a central region, thereby permitting an individual standing immediately adjacent the cords to utilize up to four of the cords at a time for a variety of combinations of pushing, pulling or rotational exercises at varying degrees of difficulty (depending upon the positioning of his arms and/or feet, for example, on the particular cords). Further, the generally radially outwardly extending configuration of the cords permits exercises to be performed by virtually any extremity of the body at any orientation desired. In a preferred embodiment, each of the cords is removably attached to the supporting frame through the use of a removable U-bolt and tear-drop connector arrangement—or simply a U-bolt, and the cords advantageously carry indicia (such as different colors or numbers) thereon to indicate the amount or degree of tension required to displace the cord by a predetermined amount. This, essentially, is a function of the diameter of the cord.

Advantageously, the supporting structure (and/or, if desired, a portion of the cord adjacent the point at which the cords are attached to the supporting structure) carry a second set of visual indicia, such as color codes or numerals which designate particular muscle groups and/or types of exercises to be performed thereon (when the appropriate cords are properly attached) in connection with a program manual or programmed exercises.

The results of the foregoing use of an array of elastic cords, such as is incorporated the present invention permits a structure which is approximately 5 feet deep by 7 feet wide by 7 feet high to perform nearly all of the exercises in a complete program for nearly all of the muscle groups of the body. If desired, a separate station (approximately 3 feet wide) may be added immediately to the side of the first station to permit certain additional exercises.

DESCRIPTION OF THE DRAWINGS

A preferred embodiment of the invention will now be described in greater detail with reference to the following figures in which.

DESCRIPTION OF THE PREFERRED EMBODIMENT

Figure 1:
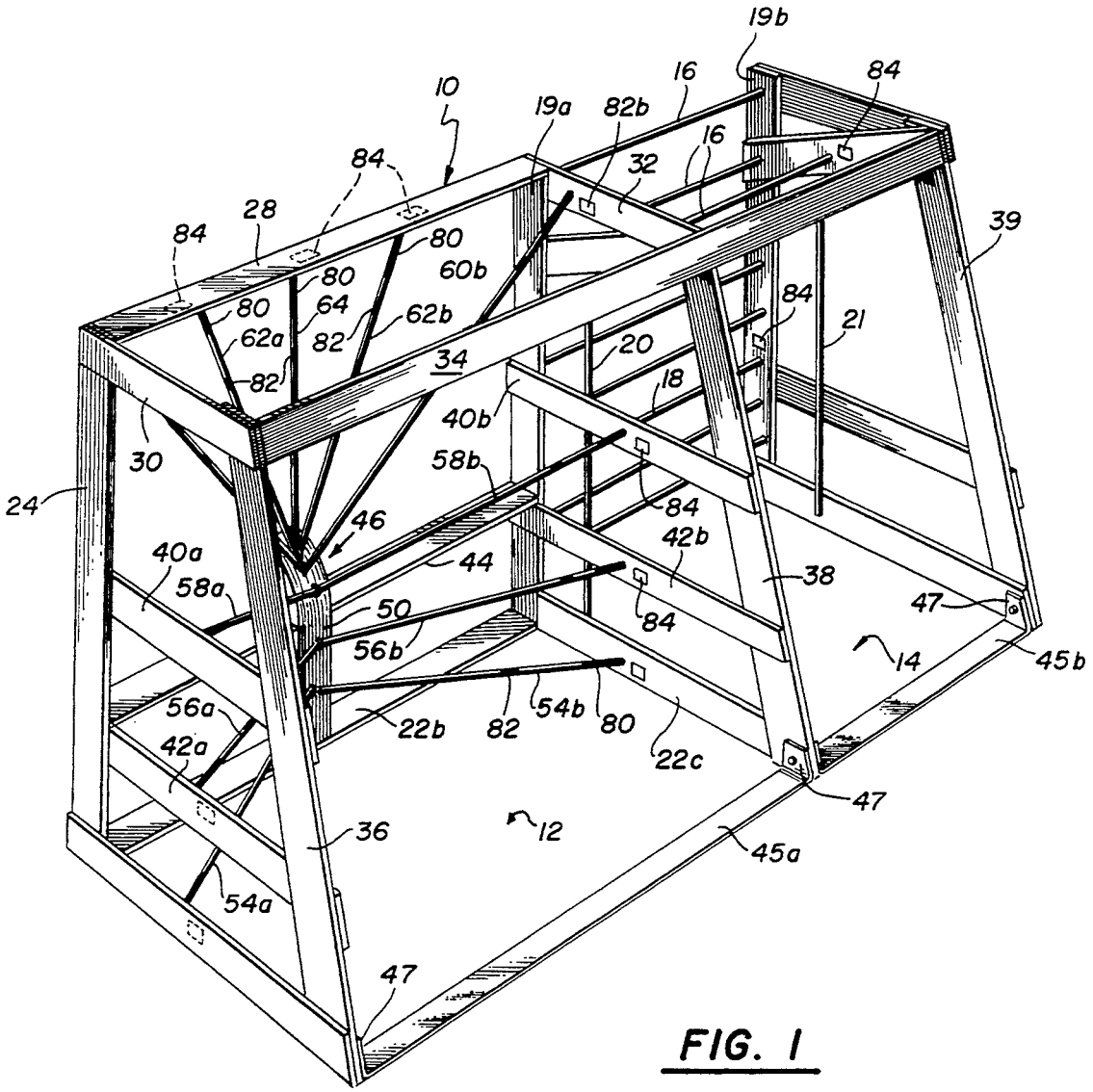
FIG. 1 is a perspective view, generally from the front, of an exercise apparatus constructed in accordance with the present invention.
Figure 2:
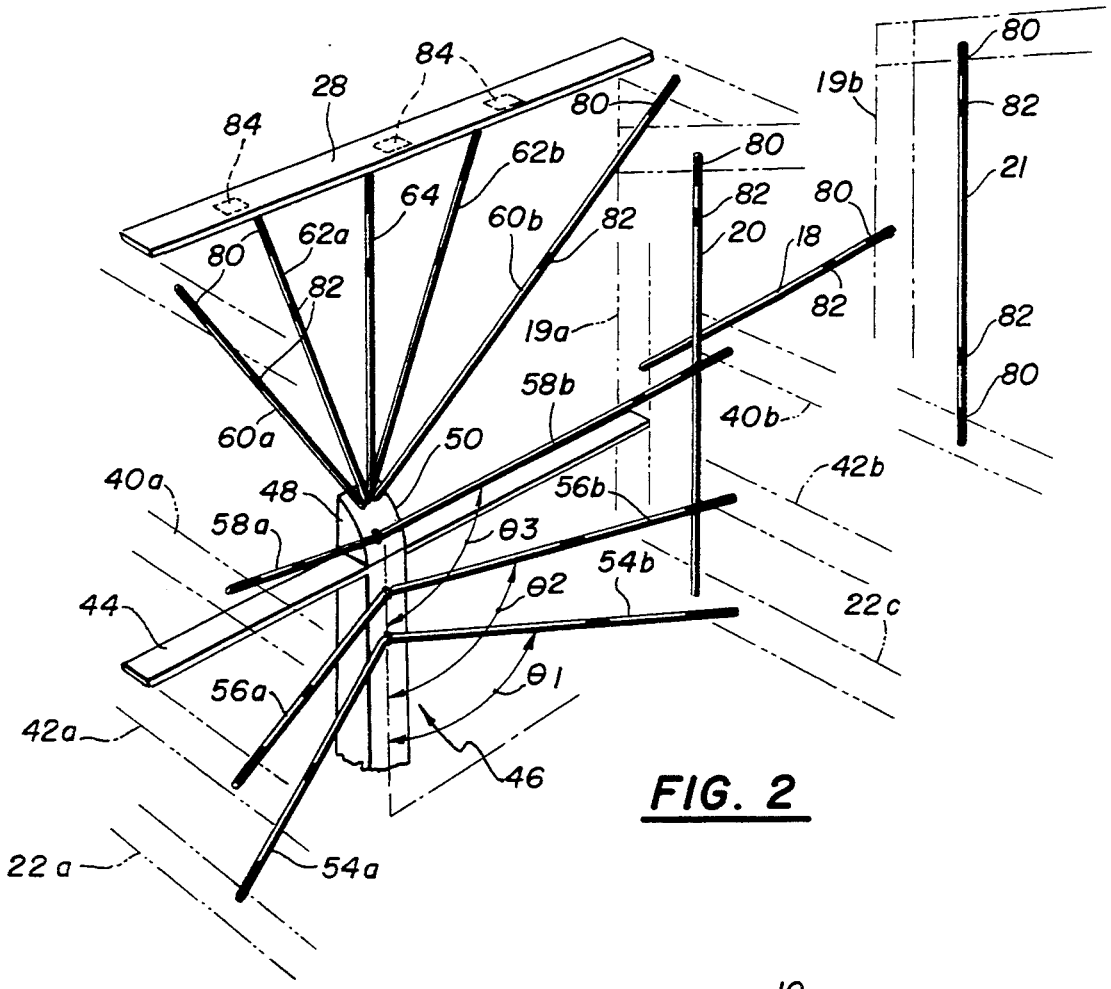
FIG. 2 is an isometric perspective view showing the shock cords, together with selected portions of the supporting structure, utilized in the exercise apparatus of FIG. 1.

Referring now to FIGS. 1–4 there is shown an exercise apparatus, constructed in accordance with the invention and generally designated 10, including two compartments, designated 12 and 14, respectively, for providing a variety of exercises. Nearly all of the exercise apparatus support frame is constructed from wood, suitably bolted or secured together by other means together. Compartment 14 contains a plurality of horizontal wooden rungs 16 and one horizontal tensioned shock cord 18 (which will be discussed below) suitably connected between vertical wooden end supports **19*a* and 19*b*. Also included in the chamber 14 are two vertical tensioned shock cords 20 and 21**, which also will be discussed in somewhat greater detail below and are suitably connected to wooden end members as shown.

The compartment 12 essentially defines a box-like enclosure having a plurality of wood bottom members 22 and two rear wood vertical support members 24 and **19*a*. A top rear wooden support member 28 is mounted on and between the vertical support members 24 and 19*a* and has attached thereto and extending forwardly wooden horizontal supports 30 and 32 which extend forwardly to a horizontal front wooden top support 34. Front wooden supports 36 and 38 (and 39 for chamber 12) extend downwardly and forward from the junctions of the top members 30 and 34 and 32 and 34, respectively. Horizontal supports 40 and 42 are provided as shown (extending between supports 24 and 36 and supports 19*a* and 38, respectively, on the left and right hand sides of the chamber 12, and a rear horizontal support 44 extends at an appropriate height from the rear vertical member 24 to the rear vertical member 19*a*. Two four inch wide plastic coated steel floor support plates 45*a*, 45*b* extend between the front wooden supports 36, 38 and 39 as shown and have upwardly extending right angle flanges 47 at their ends which are bolted to supports 36,38 and 39** as shown.

A generally P-shaped substantially vertical rear steel support 46 (four inches wide and having pluralities of pairs of apertures discussed in greater detail below therethrough) has a vertical rear portion 48 (see FIG. 2), which is bolted to and extends upwardly from the rear support 22 to a point above the rear of the horizontal rear support 44 and is securely bolted in place to the rear of the support 44. A forward curved portion 50 extends integrally from the portion 48 upwardly over the support 44 and downwardly in front of the support 44 and has the bottom thereof bolted to the front of the bottom support 226.

As will be described in greater below, a plurality of Bunji or shock cords 54, 56, 58, 60 and 62 (similar to those described in U.S. Pat. No. 3,130,630 issued to Dawes) each extends through an appropriate U bolt on the metallic supporting member to appropriate points of attachment either on the rear upper supporting member 28, on upper side support members 30 and 32 or on horizontal support members 40, 42 or 22. Each of the cords 54, 56, 58, 60 and 62 is appropriately sized so that when secured in position (as will be described in greater detail below) either to the supporting side member or top member via its respective U-bolt on the vertical metallic support member 50, it will be fully tensioned to be taut. For simplicity and clarity of explanation those portions of the shock cords 54–60 to the left of P-shaped vertical member 46 are designated additionally with the letter "a" and those portions to the right are designated additionally with the letter "b". One additional shock cord 64 is provided and extends substantially vertically upwardly (and slightly forward) from its appropriate point of attachment on a U-bolt secured to the metallic vertical supporting member 50 to the point of attachment to rear upper supporting member 28.

First and second sets of visible indicia 80 and 82 (which may be color bands or printed matter) are carried adjacent both ends of the shock cords 54–64, 18, 20 and 21. A third set of visible indicia 84 is mounted on the supporting frame adjacent the points of connection of the shock cords 18, 20, 21 and 54–64 thereto and may either be colored designators or printed matter to correspond to the particular color or printed designation (indicia 80) of the particular shock cord connected adjacent thereto and/or to provide instructions regarding the particular types of exercises which are to be performed using that particular shock cord as per instructions in a programmed exercise manual provided with the exercise apparatus 10.

Figure 5:
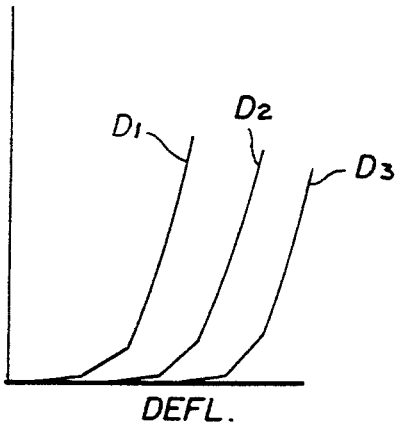
FIG. 5 is a graph indicating the deflection resisting characteristics of shock cords with decreasing diameters.
Figure 6:
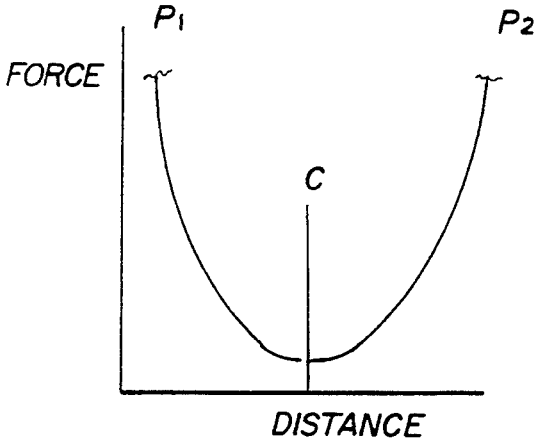
FIG. 6 is a graph indicating the force required to deflect a shock cord of a fixed diameter as a function of the distance from its central unsupported position.
Figure 4:
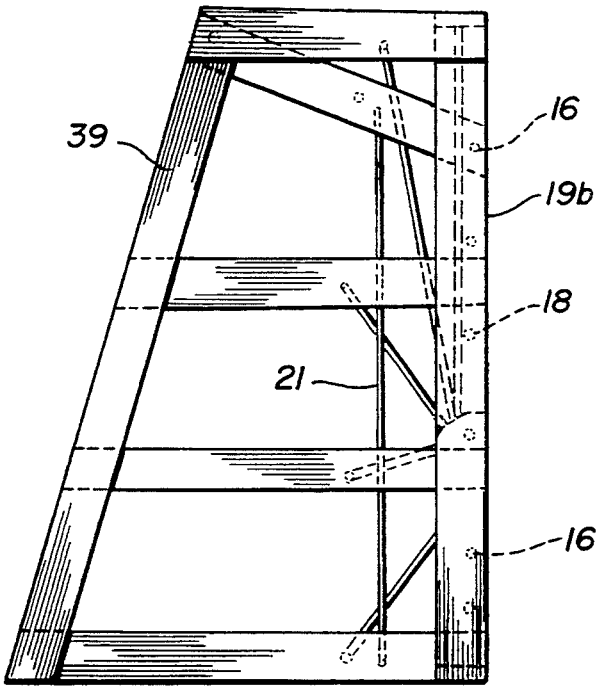
FIG. 4 is a view in side elevation, taken from the right, of the exercise apparatus of the present invention.

The second set of indicia 82 on each of the shock cords may, for example, comprise a color indicator corresponding to the degree of difficulty of flexing that particular shock cord. Referring to FIG. 5, there is shown a plurality of curves (for shock cords having decreasing diameters $D_1$, $D_2$ and $D_3$) which shows the amount of force required to deflect such shock cords a predetermined distance. FIG. 6 is a diagrammatic representation of the force required to move a shock cord a predetermined distance versus the position of application of the force on the cord. $P_1$ and $P_2$ represent points near opposite ends of attachment to the cord, and C represents the central unsupported position along the cord.

Figure 3:
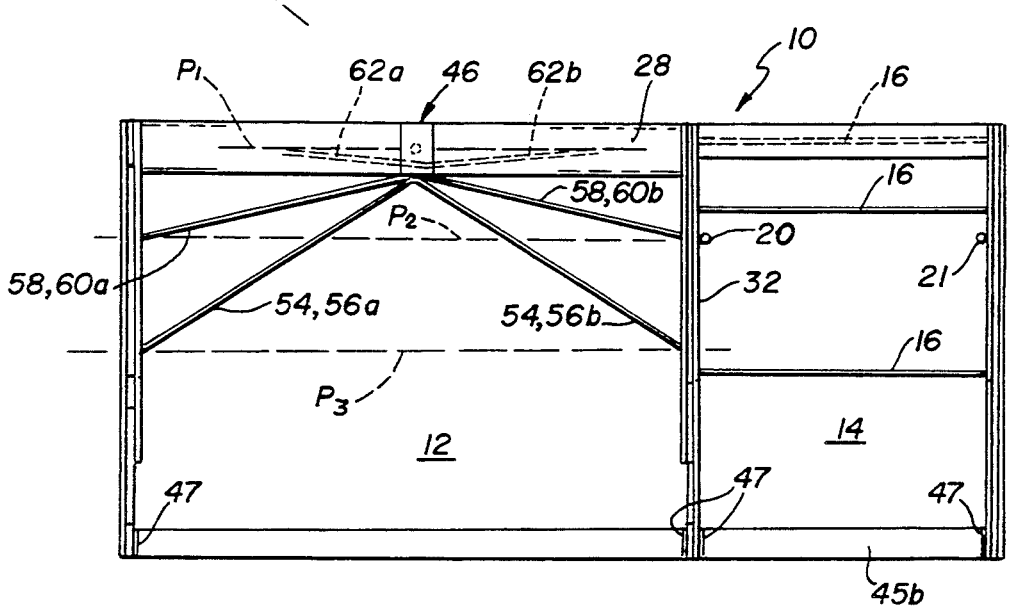
FIG. 3 is a view in top elevation of an exercise apparatus constructed in accordance with the present invention.

Thus, it will be appreciated that the amount of exertion required to perform particular exercises using the same shock cords in the array may be substantially continuously varied merely by moving the point of contact between the body, and the particular exercise using shock cords at particular angular orientations $\theta_1$–$\theta_n$ from portions of the body or a stationary support (see FIGS. 2 and 7D, E, G) may be increased merely by detaching the "color" shock cord being used, increasing the diameter of cord (different color code) to be used as a replacement, and performing the same exercise with the same directions of deflection (and it will be readily appreciated that each elastic means in the concave-shaped array of shock cords—defined by shock cords extending from one point in a first plane designated $P_1$ in FIG. 3 to another point in one of planes $P_2$ or $P_3$—is readily accessible by many portions of the body and may be deflected in substantially an unlimited number of directions) at the same positions and angular orientations of contact of particular portions of the body at the corresponding points along the new shock cords.

Figure 8:
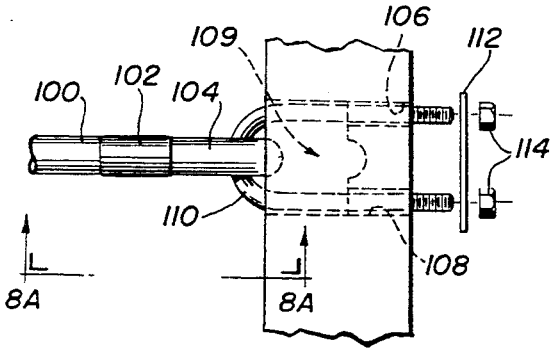
FIG. 8 is a partially exploded view in top section showing the manner of connection of the end of a shock cord to a typical wood supporting member.
Figure 8A:
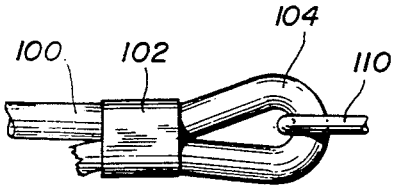

The manner of connection of the shock cords to the top or side support members (as appropriate) will now be described in greater detail with reference to FIG. 8. As is shown in FIG. 8 each cord, generally designated 100, is appropriately "served"-looped around and connected to itself (e.g., by tape 102) to define a tear-drop eyelet 104. The appropriate or top support member has a pair of bolt holes 106 and 108 extending therethrough and a U-bolt 110 is passed through the eye of the tear-drop 104 into the bolt holes 106 and 108. A recess 109 (appropriately sized and configured to receive the U-portion of the bolt 110 together with the tear-drop 104 mounted thereon in a substantially flush relationship with the front surface 111 of the support member) is provided in the front surface of the support member. A plate 112 having a pair of openings to permit the passage of the ends of the U-bolt 110 therethrough is inserted in place on the rear side of the wood member from the tear-drop 104 and suitable bolts 114 secure the plate 112 and the ends of the U-bolt 110 on the far side of the wood member with the bolt 110 and tear-drop 104 substantially flushly seated in the recess 109.

Figure 9:
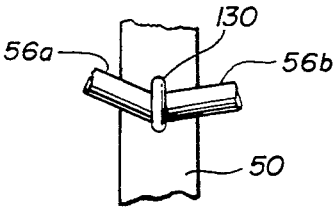
FIG. 9 is a magnified front view showing the manner of connection of a shock cord to the central metallic supporting member utilized in the invention.

FIG. 9 shows the typical manner of attachment of the shock cords to the front curved vertical support member 50. Each shock cord (for example, cord 56) passes below a U-bolt 130 which is securely bolted (through holes—not shown—in the member 50) and holds the shock cord 56 firmly in position at the proper point of attachment against the front (or upper surface of the member.

The shock cords 60, 62 and 64 extend through U-bolts 130 on the P-shaped member 50 substantially vertically upwardly in a plane $P_1$ (see FIG. 3) to points of attachment on the top support 28. The end portions of the shock cord 60 (**60*a* and 60*b*) are connected to horizontal members 40*a* and 40*b* at seated points of attachment (lying in a plane $P_2$ approximately 18 inches forward of the plane $P_1$). The bottom three shock cords have each of their left and right hand portions 54*a*, 56*a* and 58*a* and 54*b*, 56*b*, 58*b*, respectively, connected via U-bolts 130 mounted on the P-shaped member 50 to the respective horizontal support members 42 and 22 approximately within the same separate plane (designated $P_3$) which is approximately 2 feet forward of the plane $P_1$. The seating of the U-bolts 110 and tear-drops 104** within the recesses in the support members reduces the risk of injury to an extremity of the body which is engaged in an exercise close to an attachment point for a shock cord and contributes to an overall smoothness in appearance of the surfaces of the wood supporting members.

Figure 7A:
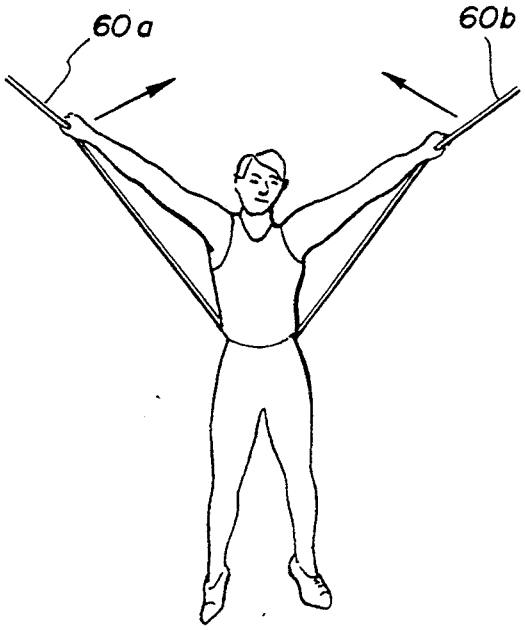
FIGS. 7A–K are diagrammatic views showing different types of exercises that may effected using the exercise apparatus of the present invention.
Figure 7B:
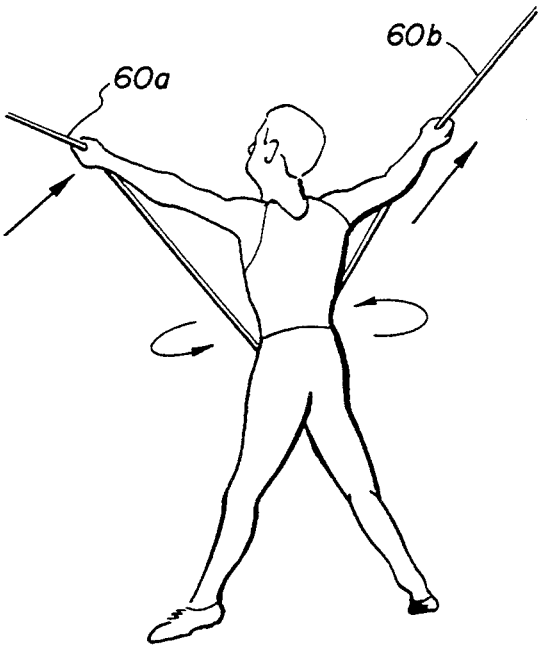
Figure 7C:
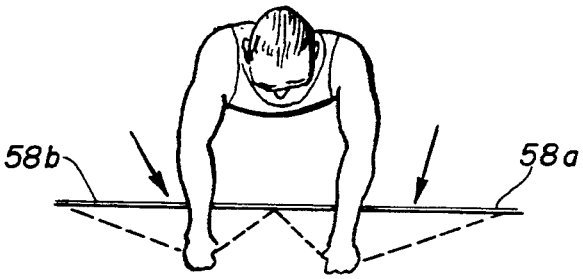
Figure 7D:
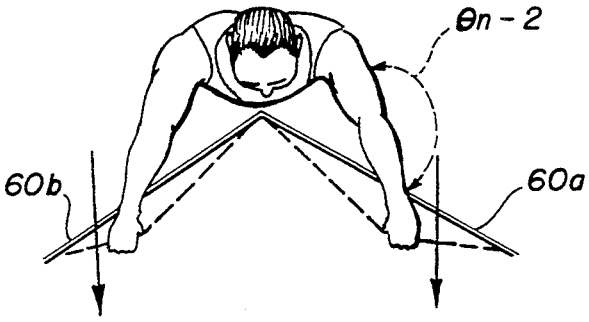
Figure 7E:
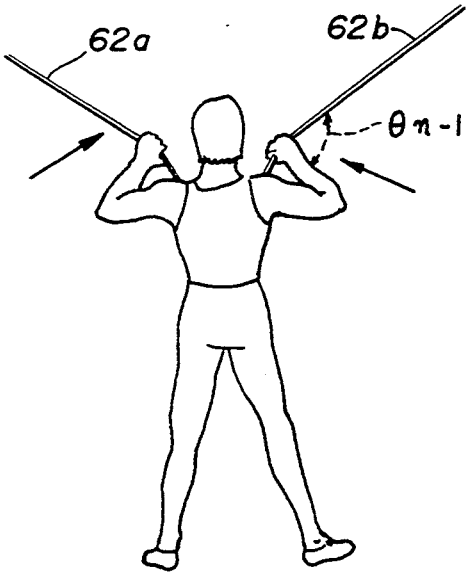
Figure 7F:
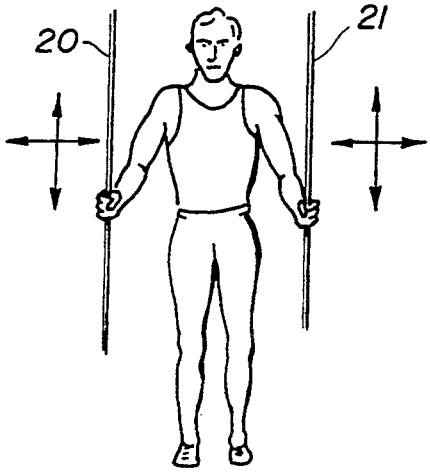
Figure 7G:
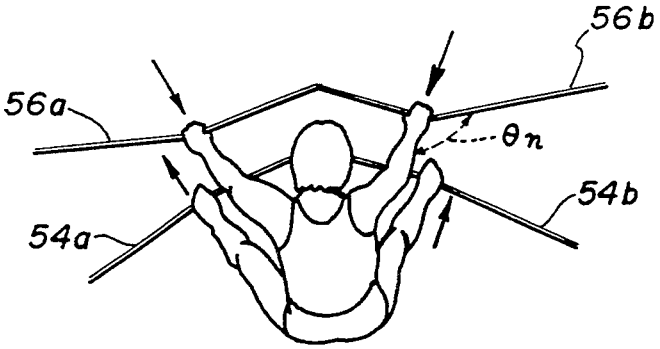
Figure 7J:
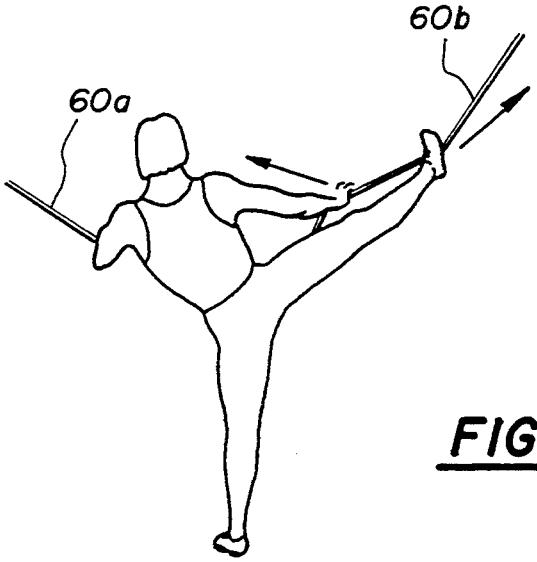
Figure 7K:
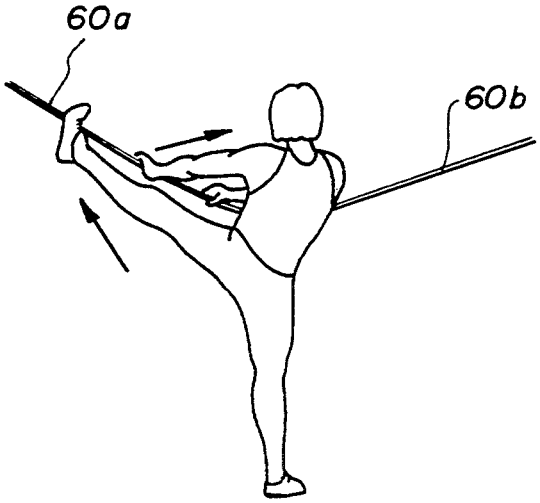
Figure 7H:
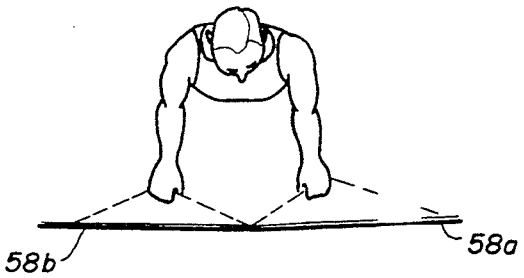
Figure 7I:
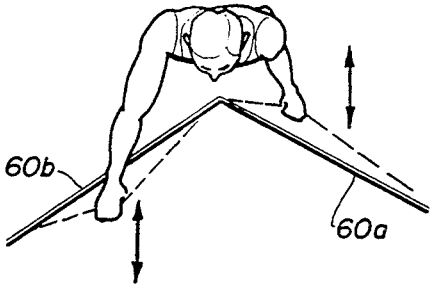

FIGS. 7A–K show a typical variety of the many types of exercises which may be performed on exercise apparatus constructed in accordance with the invention. In FIG. 7A, the person is simultaneously pulling his arms inward above and over his head. In FIG. 7B one arm is pulling inward upwardly, one is pushing upwardly inwardly, and the torso is being twisted. In FIG. 7C, a static exercise is performed by pushing away from the body on separate portions of shock cord 58. FIG. 7D shows a similar exercise on shock cords **60*a* and 60*b* at different angle orientation with the arms above the head. FIG. 7E shows the person pushing inwardly and upwardly with both arms on shock cords 52*a* and 52*b*. FIG. 7F shows a plurality of pushing and pulling (upward and downward or inward and outward) exercises which may effectively utilize shock cords 20 and 21. FIG. 7G shows an exercise in which both arms and legs may be utilized to pull portions of shock cords 56*a* and 56*b* with the arms and push portions of shock cords 54*a* and 54*b* with the feet and legs. FIG. 7H shows a semi-static exercise in which the individual pulls on separate portions of shock cords 58*a* and 58*b* which performs some additional stretching of the muscles of the individual's arms. FIG. 7I shows a ballistic exercise (combination of pushing and pulling) which may be performed above the shoulder level by alternatively pushing and pulling shock cords 60*a* and 60*b*. Finally, FIG. 7J AND 7K show combinations of arm and leg exercises which may be effected on one of cords 60*a* and 60*b*, while using the other cords 60*b* and 60*a*** for balance.

Thus, it will be appreciated, that the provision of an array of shock cords with connection points in a plurality of planes provides a simple, compact and inexpensive exercise apparatus which has high degree of flexibility and permits the individual performing exercises to exercise nearly all of the muscle groups of the body without the need for advancing to different exercise stations.

Static, semi-static and ballistic exercises may be performed, and the apparatus may be utilized to perform substantially continuously variable exercises without modification or may be modified to provide increasing or decreasing degrees of difficulty. A plurality of sets of visible indicia on the supporting structure for the exercise apparatus and on the shock cords themselves permits the individual performing the exercises to conduct a preprogrammed exercise routine and to vary the degree of difficult of exercises being performed.

The provision of releasable means for attaching the shock cords to the support structure permits simple and relatively rapid modification of the apparatus to accommodate shock cords having different strengths and to modify exercise program.

It will be appreciated, of course, that the number of shock cords shown on the described embodiment is merely exemplary and that a greater or lesser number of cords may be used while achieving the advantageous results of the invention.

Wherefore, having thus described our invention, we claim:

1. The exercise apparatus, comprising:

(a) a frame having a substantially vertical central support, a left support which includes a plurality of left connection points positioned forward of said central support, a right support which includes a plurality of right connection points positioned forward of said central support and spaced from said left connection points, and connecting means for connecting said central support to each of said right and left supports;

(b) a first set of elastic cord sections, each cord section having a first end and a second end, the first cad of each of said first set of cord sections being connected to said central support, and the second end of each of said first set of cord sections being connected to one of said left connection points at least one of the said first set of cords being sloped upward from the central support to its left connection point, and at least one of the said first set of cord sections being sloped downward from the central support to its left connection point; and (c) a second set of elastic cord sections, each cord section having a first end and a second end, the first end of each of said second set of cord sections being connected to said central support and the second end of each of said second set of cord sections being connected to one of said right connection points, at least one of the said second set of cord sections being sloped upward from the central support to its right connection point, and at least one of the said second set of cord sections being sloped downward from the central support to its fight connection point, wherein the first and second set of cord sections are positioned in a concave-shaped array to define the boundaries of an empty and unobstructed three-dimensional space, said space having a top surface, a bottom surface, a left surface defined by the first set of cord sections, a right surface defined by the second set of cords, and a front surface whose outer periphery is defined by the connection points, said front surface being unobstructed by any part of the apparatus.

* * * * *